US005183167A

United States Patent [19]

Cheng

[11] Patent Number: 5,183,167

[45] Date of Patent: Feb. 2, 1993

[54] ADJUSTABLE MULTI-DESK RACK

[76] Inventor: W. H. Cheng, No. 323, Sec. 2, An Kang Rd., Hsin, Tien, Taipei, Taiwan

[21] Appl. No.: 755,845

[22] Filed: Sep. 6, 1991

[51] Int. Cl.[5] ..... A47F 5/00

[52] U.S. Cl. ..... 211/187; 108/144; 211/207

[58] Field of Search ..... 211/187, 207; 108/144

[56] References Cited

U.S. PATENT DOCUMENTS 3,245,365 4/1966 Doherty ..... 108/144
3,709,166 1/1973 Bush ..... 108/144 X
4,627,543 12/1986 Nicely ..... 211/187
4,678,089 7/1987 Lang ..... 108/144 X
4,852,501 8/1989 Olson et al. ..... 108/144 X

*Primary Examiner*—Robert W. Gibson, Jr.
*Attorney, Agent, or Firm*—Morton J. Rosenberg; David I. Klein

[57] ABSTRACT

A multi-deck rack comprising a plurality of boards having two tapered holes at two opposite ends respectively attached with a taper ring each and mounted on two supporting posts at different levels, wherein downward pressure on the boards causes the boards to be firmly retained on the supporting posts in position; upwards pressure on the boards causes the boards to be moved upwards on the supporting posts for adjusting level positions.

2 Claims, 4 Drawing Sheets

ADJUSTABLE MULTI-DESK RACK

BACKGROUND OF THE INVENTION

The present invention relates to a multi-deck rack and relates more particularly to such a multi-deck rack having a plurality of boards mounted on two supporting posts in which the boards are firmly retained on the supporting posts upon heavy load or moved from place for adjusting level positions when an upward pressure is applied thereto respectively.

In a multi-deck rack of the type having a plurality of boards transversely mounted on two or more supporting posts, the supporting posts each has a row of holes for fastening the boards by lock pins or lock screws. By inserting the lock pins or lock screws in the holes on the supporting posts alternatively, the level positions of the boards can be changed. This structure of multi-deck rack is complicated to manufacture. The arrangement of the lock pins or lock screws may obstruct the total sense of beauty of the structure. Further, the boards can only be adjusted to the positions where the holes on the supporting posts are allocated.

SUMMARY OF THE INVENTION

The present invention has been accomplished to eliminate the aforesaid disadvantages. It is therefore the main object of the present invention to provide a multi-deck rack in which the boards can be conveniently freely adjusted to any level positions on the supporting posts thereof.

According to the present invention, there is provided a multi-deck rack which is generally comprised of a plurality of boards having two tapered holes at two opposite ends respectively attached with a taper ring each and mounted on two supporting posts at different levels. When a heavy load is placed on each board or downward pressure is applied at each board, each board becomes firmly retained in place. When an upward pressure is applied at each board, each board can be moved from place for adjusting its level position on the supporting posts.

DETAILED DESCRIPTION OF THE PREFERRED EMBODIMENTS

Figure 1:
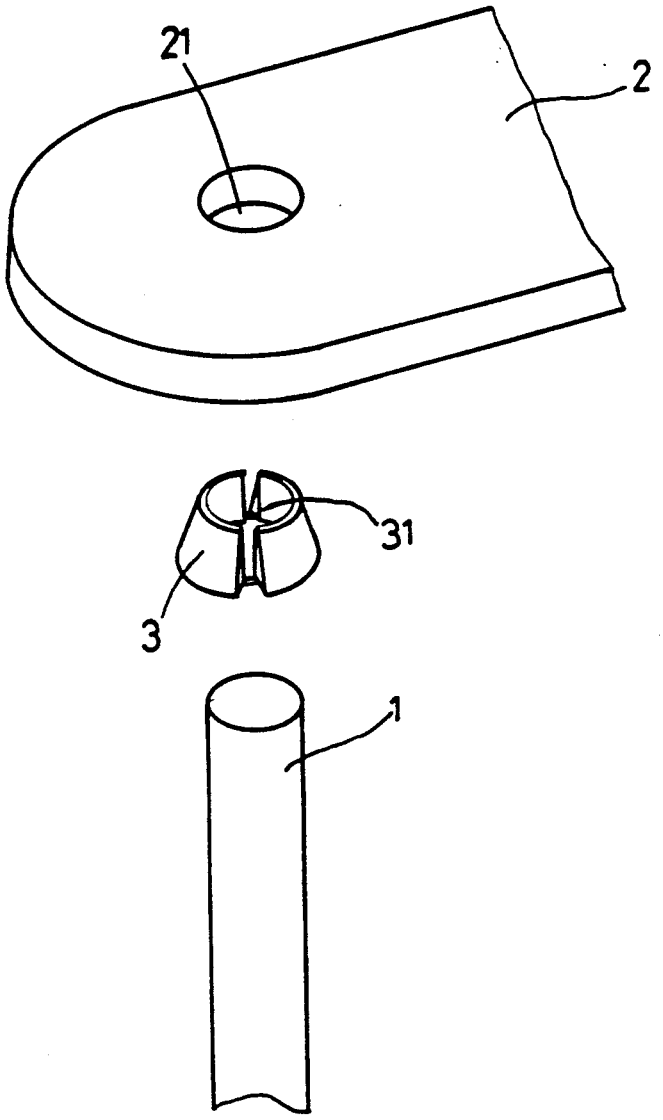
FIG. 1 is a partly dismantled view of an adjustable multi-deck rack as constructed according to the present invention.
Figure 2:
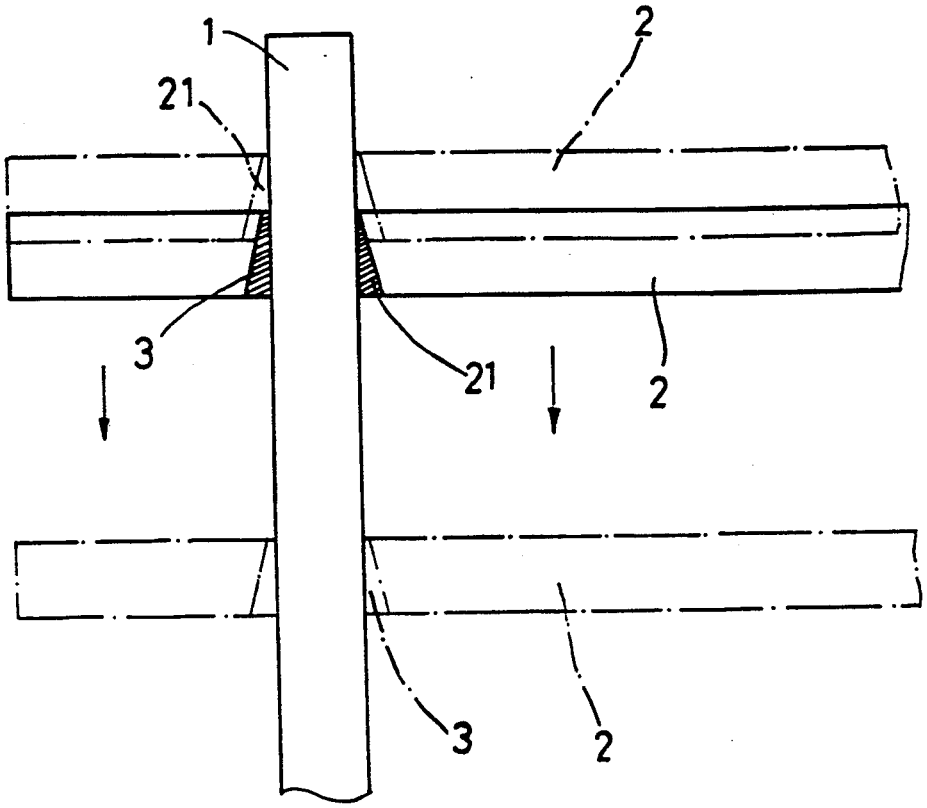
FIG. 2 is a partly sectional assembly view thereof.
Figure 3:
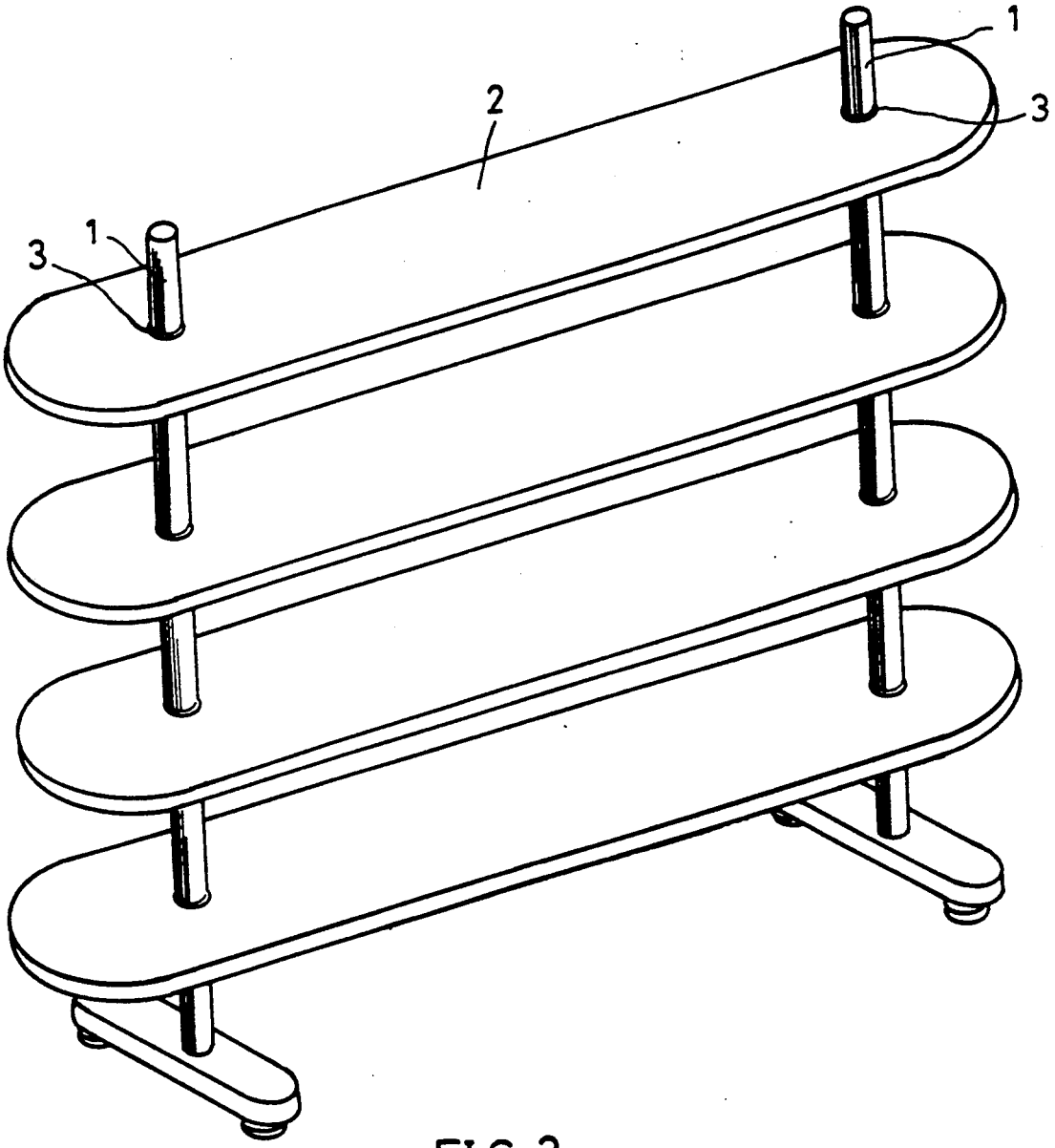
FIG. 3 illustrates the outer appearance of an adjustable multi-deck rack as constructed according to the present invention.

Referring to FIGS. 1, 2 and 3, a multi-deck rack as constructed in accordance with the present invention is generally comprised of two supporting posts 1 vertically disposed at two opposite locations and a plurality of boards 2 transversely mounted on said supporting posts 1 in different levels. Each board 2 has two tapered holes 21 at two opposite ends into which the supporting posts 1 are inserted respectively. Before mounting on the supporting posts 1, each tapered hole 21 is attached with a split taper ring 3. Pressing each board 2 downwards on the supporting posts 2 causes each taper ring 3 to reduce its boring bore 31, and therefore, the board 2 becomes firmly retained on the supporting posts 1 in position. When stronger pressure is applied at each board 2, each board 2 becomes more tightly secured to the supporting posts 1 in position. Each board 2 can only be removed from the supporting posts 1 when it is moved upwards. Therefore, each board 2 can be firmly retained on the supporting posts 1 at the desired level by moving each taper ring 3 to the desired location.

Figure 4:
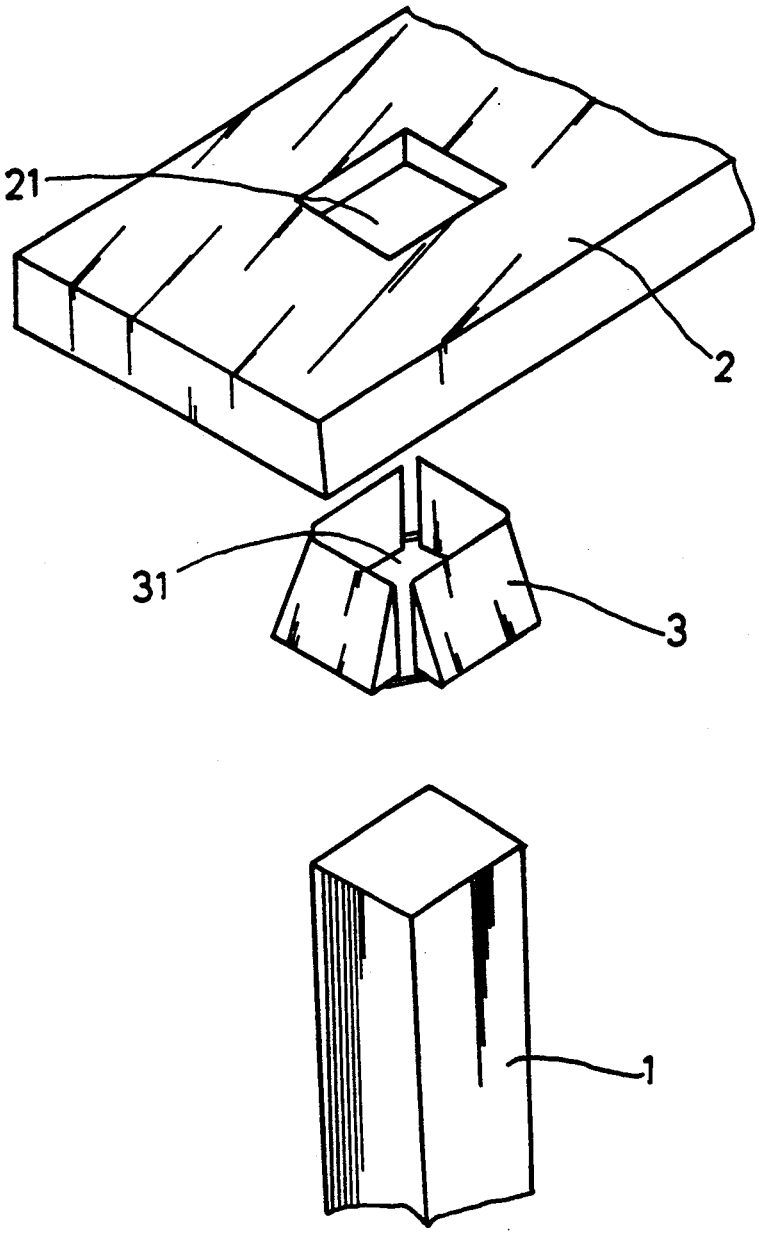
FIG. 4 is a partly dismantled view of an alternate form of the present invention.

Referring to FIG. 4, therein illustrated is an alternate form of the present invention, in which the posts 1 are respectively made from a square rod, and each taper ring 3 and each tapered hole 21 on each board 2 are respectively made in shape tightly matching the cross section of the posts 1.

What is claimed is:

1. A multi-deck rack comprising two supporting posts vertically disposed at two opposite locations and a plurality of boards transversely mounted on said supporting posts, said supporting posts having a substantially continuous outer surface contour devoid of recess openings, each of said boards each having two tapered holes formed at two opposite ends thereof with a split tapered ring fastened in each of said tapered holes for receiving insert of a respective one of said supporting posts, said tapered ring being positionable at a selected infinitely variable vertical position point on said supporting posts, wherein downward pressure applied to each of said boards applies a radial displacement pressure on said tapered rings to firmly secure said tapered rings between said supporting posts and a corresponding board, whereby each of said boards are firmly retained on said supporting posts at said selected location and upward pressure applied to said boards causes said boards to be moved upwards on said supporting posts.

2. The multi-deck rack of claim 1, wherein said tapered holes formed in said boards and said tapered rings are respectively formed in a shape corresponding to said outer surface contour of said supporting posts.

* * * * *